US005913713A

United States Patent [19]

Cheek et al.

[11] Patent Number: 5,913,713

[45] Date of Patent: Jun. 22, 1999

[54] CMP POLISHING PAD BACKSIDE MODIFICATIONS FOR ADVANTAGEOUS POLISHING RESULTS

[75] Inventors: Roger W. Cheek, Winooski; John E. Cronin, Georgia; Douglas P. Nadeau, Underhill; Matthew J. Rutten, Milton; Terrance M. Wright, Williston, all of Vt.

[73] Assignee: International Business Machines Corporation, Armonk, N.Y.

[21] Appl. No.: 08/904,288

[22] Filed: Jul. 31, 1997

[51] Int. Cl.[6] ..... B24B 1/00

[52] U.S. Cl. ..... 451/41; 451/285; 451/287; 451/6

[58] Field of Search ..... 451/6, 8, 21, 28, 451/41, 285, 287, 289, 921, 526, 490, 527, 529, 539, 443, 444, 56; 15/230; 438/14; 156/345, 645.1

[56] References Cited

U.S. PATENT DOCUMENTS

| | | | |
|---|---|---|---|
| 4,019,289 | 4/1977 | Korver . | |
| 4,226,274 | 10/1980 | Awaya et al. . | |
| 4,600,469 | 7/1986 | Fusco et al. . | |
| 4,793,895 | 12/1988 | Kaanta et al. | 156/627 |
| 4,954,141 | 9/1990 | Takiyama et al. . | |
| 5,020,283 | 6/1991 | Tuttle . | |
| 5,081,051 | 1/1992 | Mattingly et al. . | |
| 5,177,908 | 1/1993 | Tuttle . | |
| 5,212,910 | 5/1993 | Breivogel et al. . | |
| 5,216,843 | 6/1993 | Breivogel et al. . | |
| 5,257,478 | 11/1993 | Hyde et al. . | |
| 5,297,364 | 3/1994 | Tuttle . | |
| 5,302,233 | 4/1994 | Kim et al. . | |
| 5,310,455 | 5/1994 | Pasch et al. . | |
| 5,329,734 | 7/1994 | Yu . | |
| 5,433,651 | 7/1995 | Lustig et al. | 451/6 |
| 5,435,772 | 7/1995 | Yu . | |
| 5,441,598 | 8/1995 | Yu et al. . | |
| 5,643,050 | 7/1997 | Chen | 451/6 |
| 5,663,797 | 9/1997 | Sandhu | 451/6 |
| 5,664,989 | 9/1997 | Nakata et al. | 451/41 |
| 5,762,536 | 6/1998 | Pant et al. | 451/6 |
| 5,763,427 | 4/1998 | Henderson | 438/14 |
| 5,795,218 | 8/1998 | Doan et al. | 451/921 |

FOREIGN PATENT DOCUMENTS

| | | | |
|---|---|---|---|
| 0 004 454 | 10/1979 | European Pat. Off. . | |
| 1696275 | 12/1991 | U.S.S.R. | 451/6 |

*Primary Examiner*—Timothy V. Eley
*Assistant Examiner*—Derris H. Banks
*Attorney, Agent, or Firm*—Howard J. Walter, Jr.

[57] ABSTRACT

A polishing pad and method of polishing with a chemical mechanical planarization apparatus includes providing a bulk polishing pad material having a front polishing surface side and a back side. The polishing pad further includes a polishing pad wear indicator for indicating a polishing pad wear during a life cycle of the polishing pad. The polishing pad wear indicator is formed on the back side of the bulk polishing pad material.

27 Claims, 4 Drawing Sheets

CM P POLISHING PAD BACKSIDE MODIFICATIONS FOR ADVANTAGEOUS POLISHING RESULTS

BACKGROUND OF THE INVENTION

1. Field of the Invention

This invention relates generally to the field of semiconductor processing; and more specifically to the field of polishing methods and apparatus for planarizing thin films formed over a semiconductor substrate.

2. Discussion of the Related Art

In semiconductor device manufacturing of very large scale integrated (VLSI) circuits, extremely small electronic devices are formed in separate dies on a thin, flat semiconductor wafer. In general, various materials which are either conductive, insulating, or semiconducting are utilized in the fabrication of integrated circuitry on semiconductor wafers. These materials are patterned, doped with impurities, or deposited in layers by various processes to form integrated circuits. VLSI integrated circuits include patterned metal layers which are generally covered with dielectric materials, such as oxide, followed by a subsequent metalization, etc. The semiconductor wafers thus contain metalization layers and interlevel dielectrics.

Increasing circuitry miniaturization and a corresponding increase in density has resulted in a high degree of varying topography being created on an outer wafer surface during fabrication. It is often necessary to planarize a wafer surface having varying topography to provide a substantially flat planar surface. One such planarization process known in the art is chemical-mechanical polishing (CMP).

Chemical mechanical polishing or planarization has been widely used in the semiconductor industry for smoothing, polishing or planarizing coating or layers on the surface of semiconductor wafers. This process has been used to achieve the planarization, the controlled reduction in thickness, or even the complete removal of such layers which may include, for example, an oxide on the surface of the semiconductor wafer. Apparatus for such chemical mechanical polishing process is well known and used in the semiconductor industry and is currently commercially available.

Briefly, the chemical mechanical polishing process requires that a workpiece be held, with a desired coated surface face down, on a polishing pad supported on a rotating table, in the presence of an abrasive slurry. A chemical mechanical polishing machine can include a single rotating polishing plate having a polishing pad thereon and a smaller diameter rotating wafer carrier to which a wafer (or wafers) is (are) mounted. The wafer carrier is held above the polishing plate, either in a stationary fixed position or oscillating back and forth in a predetermined path in a horizontal plane, while both polishing plate and wafer carrier are rotated about their respective center axes. A slurry, consisting of an abrasive suspension with or without an etching reagent, is fed onto the polishing pad of the polishing plate during polishing of the wafer. The slurry, also referred to as a carrier liquid, can be selected to include an etchant for the coating being planarized and for not substantially attacking other materials involved in the process. The slurry is further fed between the polishing pad and the wafer being polished to polish and flush away the material removed from the semiconductor wafer.

Planarization of dielectric films using a CMP process requires varying properties for polishing pads. Soft polishing pads generally result in good global planarization (i.e., planarization across the wafer or substrate being polished) but are not very good at achieving local planarization (i.e., planarization across a single chip region on the wafer or substrate). On the other hand, hard polishing pads are very good at achieving local planarization but are not very good at achieving global planarization.

Several methods have been disclosed for achieving both local and global planarization. Such methods include the stacking of hard/soft polishing pads, placement of features of varied height on the polishing surface of the polishing pad, hard/soft regions, and grooves. With respect to the latter methods, the methods are implemented on a polishing side of the polishing pad.

In addition, with respect to CMP apparatus, polishing pad conditioning is known for providing a desired conditioning of a polishing pad during a polishing process. That is, polishing pad conditioning is used during the CMP process to provide a clean, fresh, polish surface after each wafer is planarized to a desired amount. The CMP process and polishing pad conditioning however result in a thinning of the polishing pad. For example, the thinning is in part a result of an abrasive action of a conditioning material.

Polishing pad end-of-life (EOL) can generally be indicated, for example, in one of several ways. That is, using process quality including, for example, measures of polishing uniformity, polishing rate, and polishing defects can be one method of providing an indication of polishing pad EOL. Another method may include polishing until a failure of either the pad or process, due to a thinning of the polishing pad. With advances in CMP polishing pad conditioning technology, process quality generally very good until the pad is too thin for continued safe use. In many cases a wafer limit (corresponding to a maximum safe number of wafers to be polished with a particular polishing pad, before pad EOL) is placed on pad life to insure that a particular pad is not used until it is too thin, i.e., beyond its usable life. A polishing pad wear is thus not well characterized with CMP apparatus and tools currently known in the art.

In addition, there are some conditions where a polish pad may wear unevenly which can result in poor polishing quality. Techniques to measure pad wear are time consuming and labor intensive involving topographic measurement of the pad's flatness.

It would thus be desirable to provide an improved polishing pad and polishing pad wear indicator for overcoming the problems as discussed herein above.

SUMMARY OF THE INVENTION

It is an object of the present invention is to provide a polishing pad for achieving planarization of a dielectric film at a high rate with good selectivity to the areas of high topography.

Another object of the present invention is to provide a polishing pad having an easily measurable indicator and/or gauge for use in indicating a polishing pad wear during a polishing pad life cycle.

Another object of the present invention is to provide an easy method for judging a polishing pad wear quality and end of life, enabling proactive replacement of a worn pad.

According to the present invention, a polishing pad and method of polishing with a chemical mechanical planarization apparatus include providing a bulk polishing pad material having a front polishing surface side and a back side. The polishing pad further includes a polishing pad wear indicator for indicating polishing pad wear during a life cycle of the polishing pad. The polishing pad wear indicator is formed on the back side of the bulk polishing pad material.

Further according to the present invention, the polishing pad wear indicator includes material filled grooves. The material filled grooves include alternating grooves of material having different hardnesses. A desired hard material is disposed in first grooves and a desired soft material is disposed in second grooves for providing a desired local and global planarization polishing pad performance. The hard materials and soft materials are selected to each have a hardness different from a hardness of the bulk polishing pad material.

BRIEF DESCRIPTION OF THE DRAWINGS

The foregoing and other teachings and advantages of the present invention will become more apparent upon a detailed description of the best mode for carrying out the invention as rendered below. In the description to follow, reference will be made to the accompanying drawings, where like reference numerals are used to identify like parts in the various views and in which.

DETAILED DESCRIPTION OF A PREFERRED EMBODIMENT OF THE INVENTION

Figure 1:
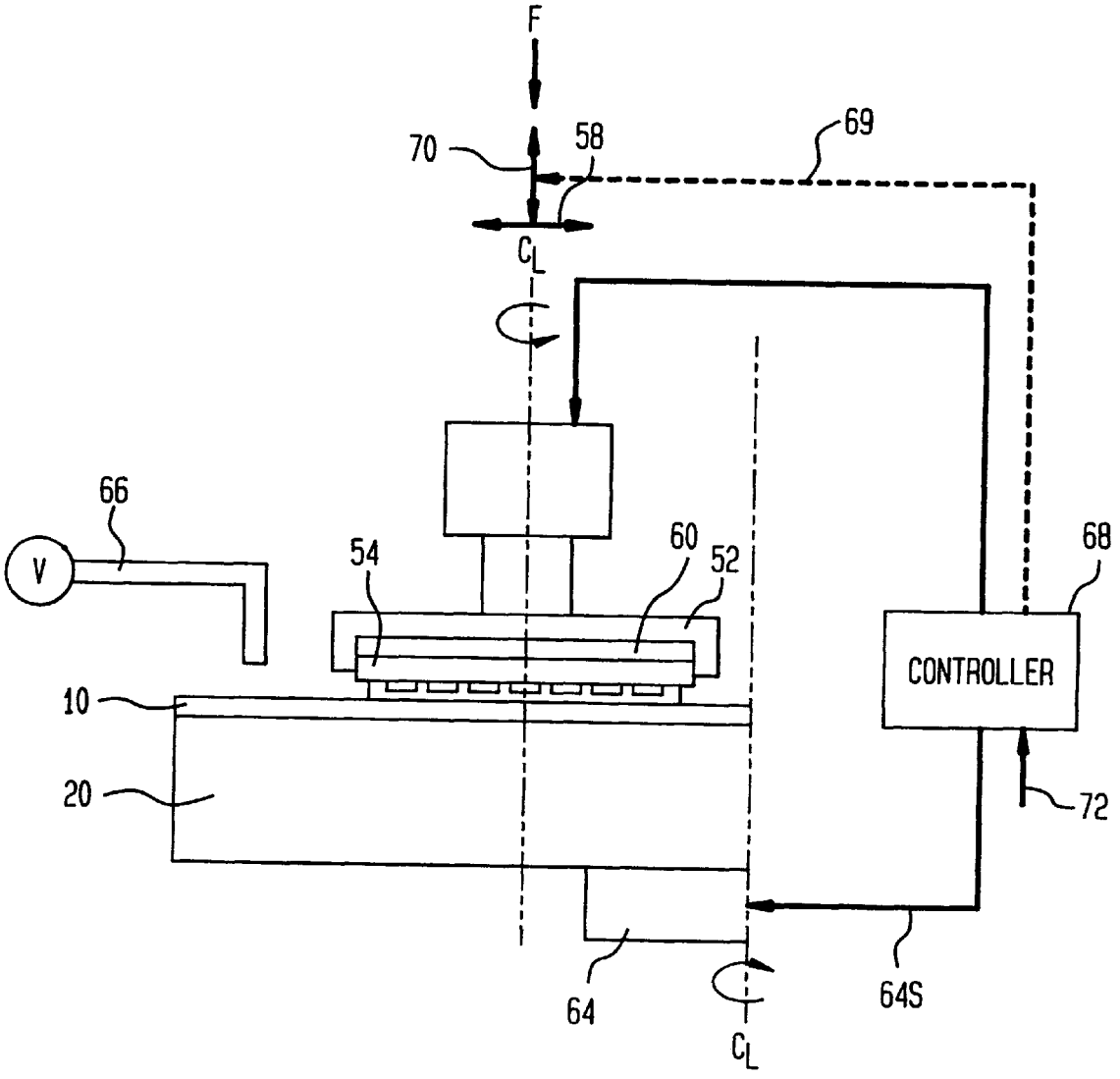
FIG. 1 is a schematic view of a chemical mechanical planarization (CMP) apparatus for use in accordance with the method and apparatus of the present invention.

Referring now to FIG. 1, an apparatus suitable for performing a chemical mechanical planarization (CMP) process in accordance with the present invention is shown and generally designated by numeral 50. The chemical mechanical planarization apparatus 50 includes a wafer carrier 52 for holding a semiconductor wafer 54. The wafer carrier 52 is mounted for rotation as desired by a drive motor 56. In addition, the wafer carrier 52 is mounted for transverse movement as desired, further as indicated by the double headed arrow 58. The wafer carrier 52 may also include a wafer carrier pad 60 formed of a soft material for contacting a backside of the wafer 54. Additionally, wafer carrier 52 may further include a vacuum holding means (not shown) for holding the wafer 54 in the wafer carrier 52 during the chemical mechanical planarization process. The wafer carrier 52 is still further adapted for exerting a downward force F upon the wafer 54. The CMP apparatus 50 further includes a polishing platen 20 mounted for rotation by a drive motor 64. A polishing pad 10, in accordance with the present invention, to be discussed in further detail herein below, is mounted to the polishing platen 20. The polishing platen 20 is relatively large in comparison to the wafer 54 so that during the CMP process, the wafer 54 may be moved according to a desired movement across the surface of the polishing pad 10 by the wafer carrier 52. A polishing slurry, generally contains an abrasive fluid, such as silica or alumina abrasive particles suspended in either a basic or an acidic solution, and is deposited through a conduit 66 onto the surface of the polishing pad 10.

Referring still to FIG. 1, a controller 68 provides signals via signal lines 56*s*, 64*s* to the wafer carrier drive motor 56 and the platen drive motor 64, respectively, for an appropriate control of the same during a polishing operation, further in accordance with a desired operation and/or planarization sequence. Controller 68 may further include an output control signal for controlling a mechanical arm or other suitable mechanical device (illustrated by the dashed line 69) for performing an intended positioning and/or movement of wafer carrier 52, such as raising and/or lowering the wafer carrier 52 above platen 62 as shown by arrow 70. Other mechanical placements of the wafer carrier 52 can also be controlled as appropriate by controller 68. Controller 68 can further include an input 72, representative, for example, of polishing parameter measured during the polishing process, for controlling a CMP process sequence being carried out upon the CMP apparatus 50 for a particular back-end-of-line VLSI wafer structure. Controller 68 preferably includes any suitable programmable controller device, such as a computer, for performing the intended operations and functions as described herein. Programmable controller devices, computers, associated interface circuitry, and the programming of the same is known in the art and not further discussed herein.

In accordance with the present invention, a backside of a polishing pad is modified to provide advantageous polishing characteristics and results, while maintaining a uniform material and structure on a polishing surface side (i.e., front side) of the polishing pad. Such a modified backside of the polishing pad can be accomplished in several ways, as discussed herein below.

Figure 2:
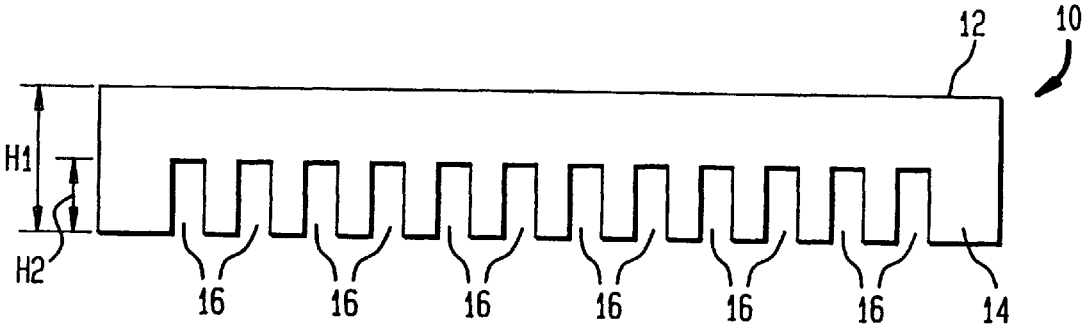
FIG. 2 shows a polishing pad having grooves in a backside thereof in accordance with one aspect of the present invention.
Figure 3:
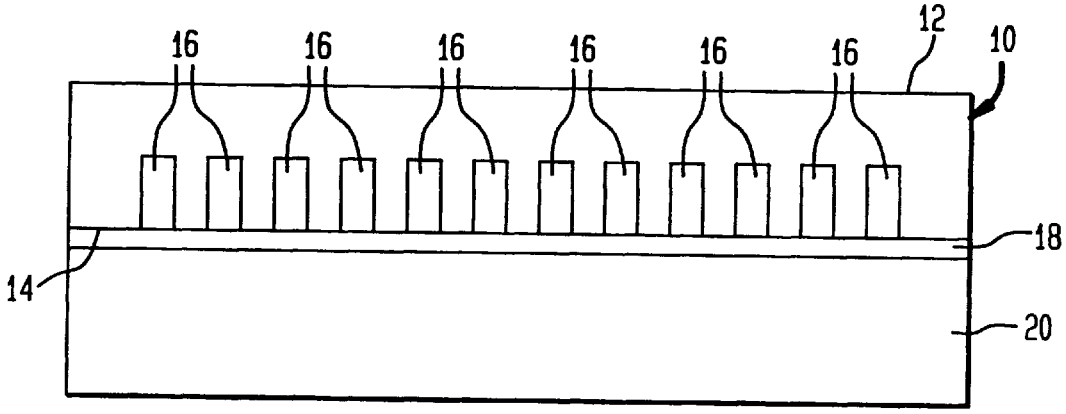
FIG. 3 shows the polishing pad of FIG. 2 having an adhesive layer and further being attached to a polishing table by the adhesive layer in accordance with the present invention.

Turning now to FIG. 2, in a first embodiment, a polishing pad 10 includes a unitary pad having a top surface 12 (alternatively, frontside) and a bottom surface 14 (alternatively, backside). Bottom surface or backside 14 of polishing pad 10 is made to include grooves 16, hereafter referred to as the grooved backside surface. Polishing pad 10 can be made, for example, of urethane or any other suitable polishing pad material such as urethane impregnated cloth or polymeric materials. The grooves 16 are formed in the backside of the polishing pad in a desired manner. For example, the grooves 16 may include a plurality of concentric grooves formed in the backside of polishing pad 10. Grooves can be formed by cutting, molding, or embossing the desired pattern into the backside 14, wherein the particular method of forming the grooves will depend upon the desired result (i.e., shape, depth, size, pad manufacturing method, etc). The polishing pad 10 preferably includes a unitary pad having a desired height dimension, as indicated by the reference "H1" in FIG. 2. Grooves 16 have a height dimension, as indicated by the reference "H2" in FIG. 2, wherein height dimension H2 is less than or equal to one-half of the height dimension H1. Grooves 16 are formed in the backside 14 of pad 10 prior to an attachment of an adhesive layer or backing 18, as shown in FIG. 3. The adhesive backing includes any suitable adhesive for used during a chemical-mechanical planarization process, preferably, pressure sensitive adhesive (PSA). Polishing pad 10, with adhesive backing 18, is attached to a polishing table 20 of a chemical-mechanical planarization apparatus by the adhesive backing 18 during a polishing operation. The grooves 16 in the backside of the polishing pad 10 provide a polishing performance in a manner similar to that provided by a stacked polishing pad, however, with performance enhancements to be further discussed herein below. For instance, the top surface 12 of the backside grooved polishing pad 10 retains an original hardness thereof for providing good local planarization during a CMP process. Additionally, the backside grooved polishing pad 10 allows for some degree of flexibility or flexing of the polishing pad for providing a good global planarization during the CMP process.

Figure 4:
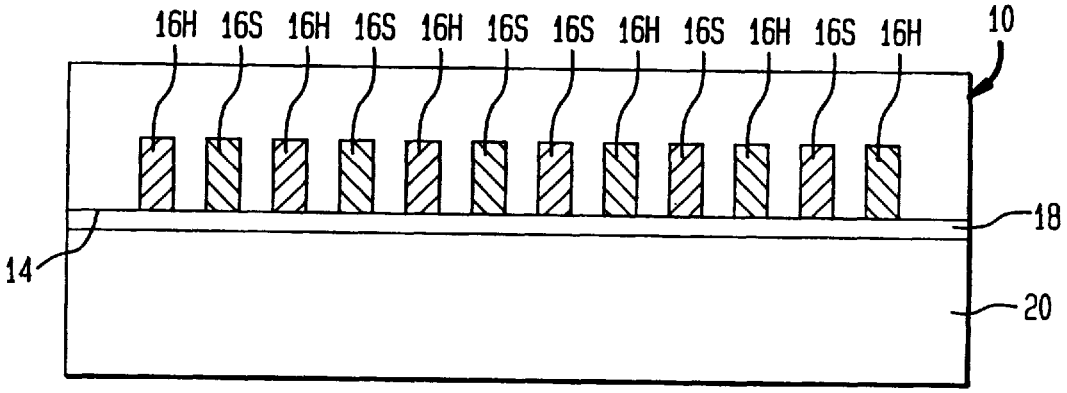
FIG. 4 illustrates a polishing pad in accordance with an alternate embodiment according to the present invention attached to a polishing table.

Turning now to FIG. 4, in another embodiment, the backside 14 of the polishing pad 10 includes a grooved backside as discussed above, or alternatively can include a backside having recessed areas or pockets therein. When referring to the use of recessed areas, the shapes of the recessed areas can be varied. That is, the shapes of the recessed areas may include squares, circles, triangles, etc. to achieve specific polish properties or to address specific planarization requirements and/or needs. In either instance of grooves or recessed areas, the grooves or recessed areas are filled with suitable soft materials, hard materials, or a combination thereof for providing a desired CMP polishing pad performance. The grooves are filled prior to application of an adhesive layer 18. Polishing pads can vary in hardness based upon the polymer or material used for the pad and the method used to form the pad. Suitable soft or hard materials placed into the grooves include a similar composition to the bulk pad material, only the material will be manufactured to be softer or harder than the bulk pad material, respectively. Similarly as discussed above, grooves or recessed areas 16 are formed in the backside of the polishing pad 10 in a prescribed manner. The grooves or recessed areas are then filled with a desired soft material, hard material, or combination thereof, to provide desired polishing pad characteristics or options as may be required for changing a planarization property of a particular type of polishing pad. For example, both hard and soft areas can be formed in the backside grooves or recessed areas, such as indicated by numerals 16H and 16S, respectively, in FIG. 4. Subsequent to the formation and filling of the backside grooves or recess areas, an adhesive backing 18 is provided on the backside surface of the polishing pad 10, further for use in mounting the polishing pad to table 20.

As discussed herein above, the present invention provides a means for achieving improved planarization through modifications to the polishing pad. The present invention further provides a more manufacturable solution to improved planarization than the making of changes to the polishing tool parameters (such as, polishing pressure, slurry content, table speed, etc.) as is typically done in the art. The present invention thus provides a novel polishing pad having backside modifications for improved CMP polishing performance.

Further in accordance with the present invention, the present invention also provides a polishing pad having an easily measurable indicator and/or gauge for indicating a degree of polishing pad wear during a polishing pad life cycle. The present invention provides an easy and simple method for judging or establishing a polishing pad wear quality and end of life, further allowing for a proactive replacement of a worn polishing pad of a CMP apparatus.

With respect to providing a measurable indicator and/or gauge for indicating a polishing pad wear during a polishing pad life cycle, an easy to identify wear indicator is provided as discussed further herein below. The indicator advantageously does not require external fixtures and or labor to identify pad wear condition.

Figure 5:
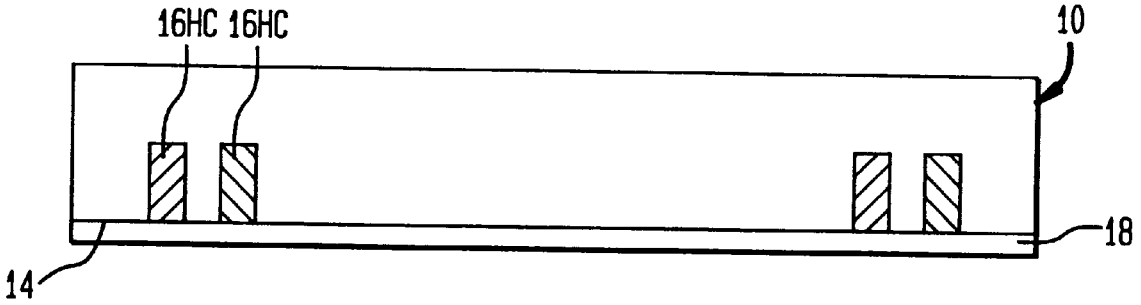
FIG. 5 illustrates a polishing pad in accordance with another alternate embodiment according to the present invention, including an adhesive layer.

According to the present invention as shown in FIG. 5, the backside grooves 16HC of the polishing pad 10 are filled with a high contrast (HC) material. The grooves or recessed areas may be filled by depositing a high contrast material therein. The high contrast material may include a dyed form of the polishing pad material or other hard or soft material as discussed herein above, for instance, so long as the high contrast material has a higher contrast than the bulk of the polishing pad. For example, the polishing pad material may include urethane and the high contrast material may include a high contrast dyed form of urethane.

With respect to the pad wear indicator according to the present invention, pad wear can be judged, assessed, or determined by a visible appearance, for example, including a brightness or brightness uniformity of the high contrast material as viewed from the top of the polishing pad. As shown in FIG. 5, the wear indicator includes two grooves 16HC, shown in cross-section, wherein the grooves further include concentric circular grooves if viewed from above or below. With the high contrast material, as the polishing pad wears thinner during use, the high contrast material becomes visible through the polishing pad, wherein the polishing pad has a somewhat translucent property as it is thinned. That is, as the pad wears, the high contrast material of the grooves becomes visibly brighter (or alternatively, more pronounced) when being viewed from the top surface of the polishing pad. If the polishing pad is worn in a non-uniform manner, then the color brightness of the underlying high contrast material will also vary across the polishing pad when view the polishing pad from the top surface. Thus, in the case of non-uniform wear, a simple indication is provided. Similarly, an end-of-life for the polishing pad can also be determined by a prescribed brightness of the underlying high contrast material as viewed through the top surface of the polishing pad.

Figure 6:
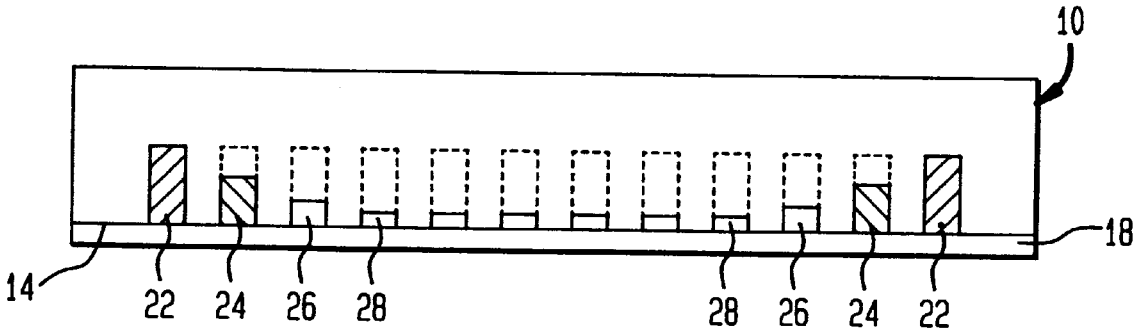
FIG. 6 illustrates a polishing pad in accordance with yet another alternate embodiment according to the present invention, including an adhesive layer.

In addition, the grooves and/or recessed areas in the backside of the polishing pad can include varied depths of high contrast material, for example, as shown in FIG. 6. The varied depths may correspond to a measure of pad wear amount in percentages, such as, twenty-five percent (25%), fifty percent (50%), seventy-five percent (75%), ninety percent (90%), etc.. In FIG. 6, the varied depths corresponding to percentage of pad wear for 25%, 50%, 75%, and 90% are indicated by reference numerals 22, 24, 26, and 28, respectively. As mentioned earlier, the grooves may include concentric circular grooves. The grooves may further be filled with various materials, such as alternating hard and soft material between adjacent grooves. Also, using the hard and soft fill material, various depths of high contrast may be added to the same. The hard and/or soft material fill can thus be modified to have a high contrast accordingly to provide the various desired depths of high contrast material in each corresponding groove. The indication of polishing pad wear is thus indicated by the brightness as seen from the front side of the polishing pad. In the present instance, the brightness of various areas will vary with the thickness of pad material remaining over each high contrast material region of varying depth. For example, in FIG. 6, the outer perimeter region of the polishing pad includes grooves 24 with a high contrast portion for indicating a 25% pad wear, compared with an inner region of the polishing pad having grooves 28 with a high contrast portion for indicating a 90% pad wear.

Figure 7:
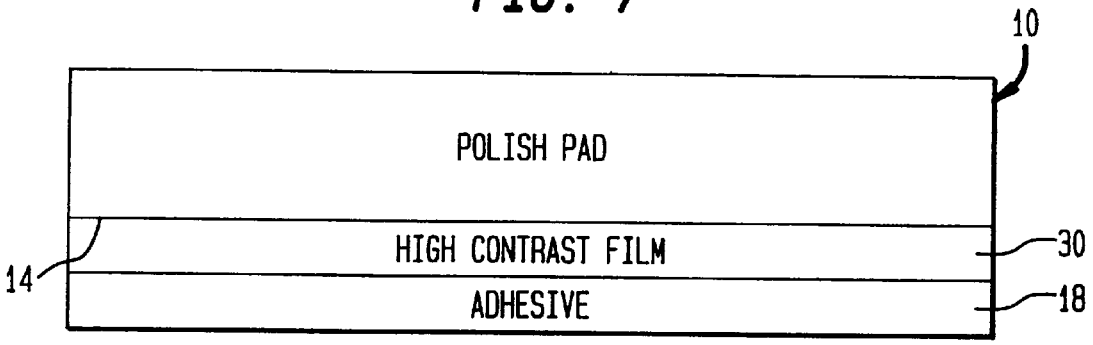
FIG. 7 illustrates a polishing pad in accordance with still yet another alternate embodiment according to the present invention, including an adhesive layer.
Figure 8:
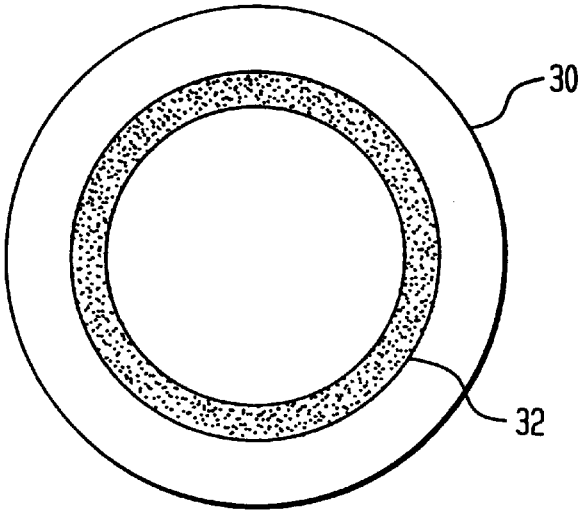
FIG. 8 illustrates a high contrast pattern used with the polishing pad of the present invention.
Figure 9:
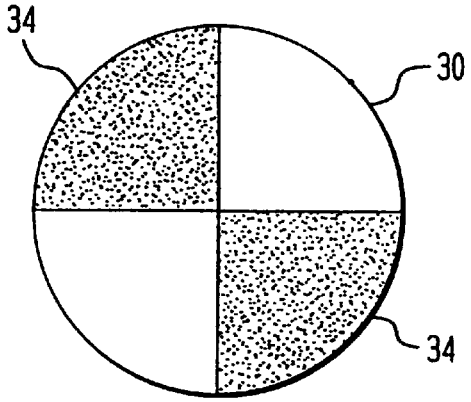
FIG. 9 illustrates an alternate high contrast pattern used with the polishing pad of the present invention.

According to another embodiment of the wear indicator of the present invention, a film laminate is provided for indication of polishing pad wear. Referring now to FIG. 7, a high contrast film layer having a desired high contrast image thereon is placed between the adhesive layer 18 and the polishing pad material on the backside 14 of the polishing pad 10. With the high contrast film layer having the desired high contrast image thereon, as the pad wears thinner during use, the high contrast film image becomes visible through the polishing pad, wherein the polishing pad exhibits a somewhat translucent characteristic. Thus, as the polishing pad wears, the high contrast film image becomes brighter. If the pad is worn in a non-uniform manner, then the color brightness of the underlying high contrast film image will vary across the polishing pad when viewing the top surface thereof. Thus, in the case of non-uniform polishing pad wear, a simple indication is provided. Similarly, an end-of-life for the polishing pad can also be determined, for example, by a prescribed brightness of the underlying high contrast material being observed. Examples of possible high contrast images for use in the high contrast film layer 30 are shown in FIGS. 8 and 9. In FIG. 8, the high contrast image may include one circle 32 (or more) of high contrast thereon. Alternatively, in FIG. 9, the high contrast image may include solid high contrast quarter circle portions 34. The high contrast image is selected in accordance with a desired polishing pad wear indication.

Yet another embodiment of the present invention includes the method of dying an existing pad on a backside surface thereof. In this latter method, areas of the polishing pad are dyed with a high contrast color to provide results similar as discussed herein above with respect to the use of high contrast material filled grooves of various depths. In this instance, however, the dye is applied to absorbent polishing pads, such as those not made of urethane. Examples of absorbent polishing pads include felt or cloth type pads. With dying of the polishing pad backside according to a particular high contrast pattern or wear indication design, a suitable high contrast dye is applied in selected backside areas by any suitable method or methods, such as, silk screening to form specific areas of high contrast- in the polishing pad backside. The high contrast patterns may be similar to those high contrast images as shown in and discussed above with respect to FIGS. 8 and 9. The penetration depth of the dye can be controlled in a manner much the same way as it is controlled in standard printing or silk screening methods.

The present wear indicator polishing pad as discussed herein advantageously provides a simple indicator of pad wear and wear uniformity. The present wear indicator can be applied to a wide range of pad types and compositions. The polishing pad wear indicator as discussed utilizes modifications to the polishing pad backside for providing advantageous results as viewed from a front side of the polishing pad, the front side being the side of the polishing pad which contacts a wafer or substrate being polished.

The modification to the backside of the polishing pad thus provides an advantageous polishing effect for CMP process and apparatus. In one embodiment, the backside modification includes the formation of grooves or pockets in the backside of the polishing pad and the placement of a high contrast material in the grooves or pockets, wherein the backside high contrast material filled grooves or pockets provide an indicator of pad wear and pad wear uniformity or quality. In another embodiment, the backside modification of the polishing pad includes the placing of a high contract material on a backside of the polishing pad between the polishing pad and an adhesive backing to provide an indicator of pad wear and pad wear uniformity or quality. Still further, in an embodiment of the present invention, the backside modification includes dyeing desired regions of the polishing pad backside with a high contrast dye for providing an indicator of pad wear and pad wear uniformity or quality.

While the invention has been particularly shown and described with reference to specific embodiments thereof, it will be understood by those skilled in the art that various changes in form and detail may be made thereto, and that other embodiments of the present invention beyond embodiments specifically described herein may be made or practice without departing from the spirit and scope of the present invention as limited solely by the appended claims.

What is claimed is:

1. A polishing pad for use in a chemical mechanical planarization apparatus for chemical mechanical polishing, said polishing pad comprising:

a bulk polishing pad material having a front polishing surface side and a back side; and indicator means for indicating a polishing pad wear during a life cycle of said polishing pad, said polishing pad wear indicator means being formed on the back side of said bulk polishing pad material.

2. The polishing pad of claim 1, further comprising an adhesive layer disposed on the back side of the bulk polishing pad material, said adhesive layer for use in mounting said polishing pad to a polishing table of a chemical mechanical planarization apparatus.

3. The polishing pad of claim 1, wherein said indicator means includes material filled grooves formed in the back side of said bulk polishing pad material.

4. The polishing pad of claim 3, further wherein the material filled grooves include alternating grooves of material having different hardnesses, the alternating grooves having a desired hard material in first grooves and a desired soft material in second grooves, the hard materials and soft materials each having a hardness different from a hardness of said bulk polishing pad material for providing a desired local and global planarization polishing pad performance.

5. The polishing pad of claim 3, wherein the material filled grooves each include a portion thereof having a high contrast, the high contrast portion of the material filled grooves having a contrast higher with respect to said bulk polishing pad material.

6. The polishing pad of claim 5, wherein said bulk polishing pad material includes urethane and said indicator means includes a high contrast dyed form of urethane.

7. The polishing pad of claim 5, still further wherein the high contrast portion of the grooves corresponds to providing a certain percentage indication of polishing pad wear.

8. The polishing pad of claim 7, wherein percentage polishing pad wear indications provided by the high contrast portion of the material filled grooves correspond to one of the following selected from the group consisting of twenty-five percent (25%), fifty percent (50%), seventy-five percent (75%), and ninety percent (90%) polishing pad wear.

9. The polishing pad of claim 1, wherein said indicator means includes a plurality of concentric grooves formed in the back side of said bulk polishing pad material.

10. The polishing pad of claim 1, wherein said indicator means includes recessed areas formed in the back side of said bulk polishing pad material, the recessed areas having varied shapes selected from the group consisting of squares, circles, and triangles.

11. The polishing pad of claim 1, wherein said indicator means includes a film layer having a desired high contrast image, the high contrast image having a contrast higher with respect to said bulk polishing pad material.

12. The polishing pad of claim 11, wherein the high contrast image includes a circle of high contrast.

13. The polishing pad of claim 11, wherein the high contrast image includes solid high contrast quarter circle portions.

14. A chemical mechanical planarization apparatus for chemical mechanical polishing having a polishing pad disposed upon a polishing table, said polishing pad comprising:

a bulk polishing pad material having a front polishing surface side and a back side; and indicator means for indicating a polishing pad wear during a life cycle of said polishing pad, said polishing pad wear indicator means being formed on the back side of said bulk polishing pad material.

15. A method of polishing with a chemical mechanical planarization apparatus for chemical mechanical polishing, comprising the steps of:

providing a polishing pad of a bulk polishing pad material having a front polishing surface side and a back side; and providing a means for indicating a polishing pad wear during a life cycle of the polishing pad, the polishing pad wear indicator being formed on the back side of the bulk polishing pad material.

16. The method of claim 15, further comprising providing an adhesive layer disposed on the back side of the bulk polishing pad material, the adhesive layer for use in mounting the polishing pad to a polishing table of the chemical mechanical planarization apparatus.

17. The method of claim 15, wherein the polishing pad wear indicator includes material filled grooves formed in the back side of the bulk polishing pad material.

18. The method of claim 17, further wherein the material filled grooves include alternating grooves of material having different hardnesses, the alternating grooves having a desired hard material in first grooves and a desired soft material in second grooves, the hard materials and soft materials each having a hardness different from a hardness of the bulk polishing pad material for providing a desired local and global planarization polishing pad performance.

19. The method of claim 17, wherein the material filled grooves each include a portion thereof having a high contrast, the high contrast portion of the material filled grooves having a contrast higher with respect to the bulk polishing pad material.

20. The method of claim 19, wherein the bulk polishing pad material includes urethane and the polishing pad wear indicator includes a high contrast dyed form of urethane.

21. The method of claim 19, still further wherein the high contrast portion of the grooves corresponds to providing a certain percentage indication of polishing pad wear.

22. The method of claim 21, wherein percentage polishing pad wear indications provided by the high contrast portion of the material filled grooves correspond to one of the following selected from the group consisting of twenty-five percent (25%), fifty percent (50%), seventy-five percent (75%), and ninety percent (90%) polishing pad wear.

23. The method of claim 15, wherein the polishing pad wear indicator includes a plurality of concentric grooves formed in the back side of the bulk polishing pad material.

24. The method of claim 15, wherein the polishing pad wear indicator includes recessed areas formed in the back side of the bulk polishing pad material, the recessed areas having varied shapes selected from the group consisting of squares, circles, and triangles.

25. The method of claim 15, wherein the polishing pad wear indicator includes a film layer having a desired high contrast image, the high contrast image having a contrast higher with respect to the bulk polishing pad material.

26. The method of claim 25, wherein the high contrast image includes a circle of high contrast.

27. The method of claim 25, wherein the high contrast image includes solid high contrast quarter circle portions.

* * * * *